US010801488B2

(12) United States Patent
Mou et al.

(10) Patent No.: US 10,801,488 B2
(45) Date of Patent: Oct. 13, 2020

(54) GAS TRANSPORTATION DEVICE

(71) Applicant: Microjet Technology Co., Ltd., Hsinchu (TW)

(72) Inventors: Hao-Jan Mou, Hsinchu (TW); Chun-Lung Tseng, Hsinchu (TW); Che-Wei Huang, Hsinchu (TW); Chien-Tang Wen, Hsinchu (TW); Shih-Chang Chen, Hsinchu (TW); Yung-Lung Han, Hsinchu (TW); Chi-Feng Huang, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 203 days.

(21) Appl. No.: 16/057,179

(22) Filed: Aug. 7, 2018

(65) Prior Publication Data

US 2019/0063422 A1 Feb. 28, 2019

(30) Foreign Application Priority Data

Aug. 31, 2017 (TW) ..... 106129731 A

(51) Int. Cl.
*F04B 45/047* (2006.01)
*F04B 39/12* (2006.01)

(52) U.S. Cl.
CPC ..... *F04B 45/047* (2013.01); *F04B 39/121* (2013.01); *F04B 39/123* (2013.01)

(58) Field of Classification Search
CPC ..... F04B 45/047; F04B 39/121; F04B 39/123
See application file for complete search history.

(56) References Cited

U.S. PATENT DOCUMENTS

| | | | | |
|---|---|---|---|---|
| 10,529,911 | B2 * | 1/2020 | Chen | F16K 99/0015 |
| 2011/0076170 | A1 * | 3/2011 | Fujisaki | F04B 45/047 417/415 |
| 2018/0066762 | A1 * | 3/2018 | Han | F16K 31/02 |
| 2019/0060943 | A1 * | 2/2019 | Mou | B05B 17/0607 |
| 2019/0063418 | A1 * | 2/2019 | Mou | F04B 43/026 |
| 2019/0063423 | A1 * | 2/2019 | Mou | F04B 39/123 |

FOREIGN PATENT DOCUMENTS

| | | | |
|---|---|---|---|
| CN | 102046978 | A | 5/2011 |
| CN | 203561485 | U | 4/2014 |
| CN | 204627942 | U | 9/2015 |
| JP | 2009-250132 | A | 10/2009 |
| TW | M542330 | U | 5/2017 |
| TW | M543870 | U | 6/2017 |

* cited by examiner

*Primary Examiner* — Charles G Freay
(74) *Attorney, Agent, or Firm* — Birch, Stewart, Kolasch & Birch, LLP

(57) ABSTRACT

A gas transportation device includes a casing, a nozzle plate, a chamber frame, an actuator, an insulating frame and a conducting frame, which are stacked sequentially. A cuboidal resonance chamber is defined by the actuator, the chamber frame and a suspension plate of the nozzle plate collaboratively. When the actuator is driven, the nozzle plate is subjected to a resonance and the suspension plate of the nozzle plate vibrates in the reciprocating manner. Consequently, the gas is transported to a gas-guiding chamber through at least one interspace and discharged from the discharging opening so as to implement the gas circulation.

19 Claims, 8 Drawing Sheets

GAS TRANSPORTATION DEVICE

FIELD OF THE INVENTION

The present disclosure relates to a gas transportation device, and more particularly to a miniature and silent gas transportation device for transporting gas at a high speed.

BACKGROUND OF THE INVENTION

In various fields such as pharmaceutical industries, computer techniques, printing industries or energy industries, the products are developed toward elaboration and miniaturization. The fluid transportation devices are important components that are used in, for example micro pumps, micro atomizers, printheads or industrial printers. Therefore, it is important to provide an improved structure of the fluid transportation device.

With the rapid development of technology, the applications of gas transportation devices are becoming more and more diversified. For example, gas transportation devices are gradually popular in industrial applications, biomedical applications, medical care applications, heat dissipation applications, or even the wearable devices. It is obvious that the trends of designing gas transportation devices are toward a miniature structure having maximum flow rate.

In accordance with the existing technologies, the gas transportation device is assembled by stacking a plurality of conventional mechanical parts. For achieving the miniature and slim benefits of the overall device, all mechanical parts are minimized or thinned. However, since the individual mechanical part is minimized, it is difficult to control the size precision and the assembling precision. Consequently, the product yield is low and inconsistent, or even the flow rate of the gas transportation is not stable. Moreover, as the conventional gas transportation device is employed, since the outputted gas fails to be effectively converged, or the component size is too small, the pushing force of the gas transportation is usually insufficient. In other words, the flow rate of the gas transportation is low.

Therefore, there is a need of providing a miniature gas transportation device applied in various devices to make the apparatus or equipment utilized in the conventional gas transportation device achieve small-size, miniature and silent benefits in order to eliminate the above drawbacks.

SUMMARY OF THE INVENTION

An object of the present disclosure provides a gas transportation device having a special fluid channel and a special nozzle plate. Consequently, the gas transportation device is small, miniature and silent and has enhanced size precision.

Another object of the present disclosure provides a gas transportation device having a cuboidal resonance chamber and a special conduit. A Helmholtz resonance effect is produced by a piezoelectric plate and the cuboidal resonance chamber. Consequently, a great amount of gas is converged and discharged at a high speed, wherein the converged gas is in the ideal fluid state complying with the Bernoulli's principle. Consequently, the purpose of transporting the great amount of the gas is achieved.

In accordance with an aspect of the present disclosure, a gas transportation device is provided for transporting gas. The gas transportation device includes a casing, a nozzle plate, a chamber frame, an actuator, an insulating frame and a conducting frame. The casing has at least one fixing recess, an accommodation recess and a discharging opening. The accommodation recess has a bottom wall. The nozzle plate has at least one bracket, a suspension plate and a through hole. The suspension plate is permitted to undergo a bending vibration. The at least one bracket is disposed in the at least one fixing recess for positionally accommodating the nozzle plate within the accommodation recess. A gas-guiding chamber is formed between the nozzle plate and the bottom wall of the accommodation recess. The gas-guiding chamber is in communication with the discharging opening. Moreover, at least one interspace is formed among the at least one bracket, the suspension plate and the casing. The chamber frame is stacked on the suspension plate. The actuator is stacked on the chamber frame. In response to a voltage applied to the actuator, the actuator undergoes a bending vibration in a reciprocating manner. The insulating frame is stacked on the actuator. The conducting frame is stacked on the insulating frame. A cuboidal resonance chamber is defined by the actuator, the chamber frame and the suspension plate collaboratively. When the actuator is driven, the nozzle plate is subjected to a resonance, so that the suspension plate of the nozzle plate vibrates in the reciprocating manner. Consequently, the gas is transported to the gas-guiding chamber through the at least one interspace and is discharged from the discharging opening so as to implement the gas circulation.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
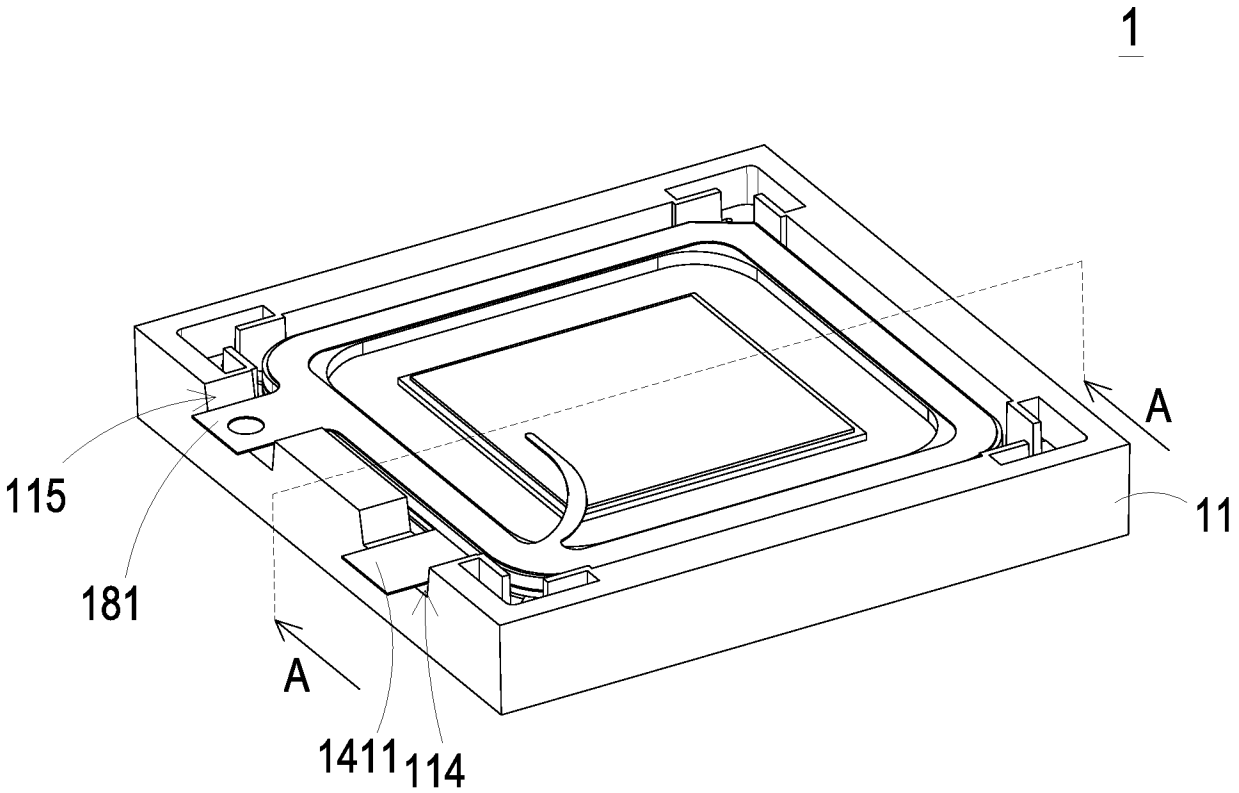
FIG. 1 is a schematic perspective view illustrating a gas transportation device according to some embodiments of the present disclosure.
Figure 2A:
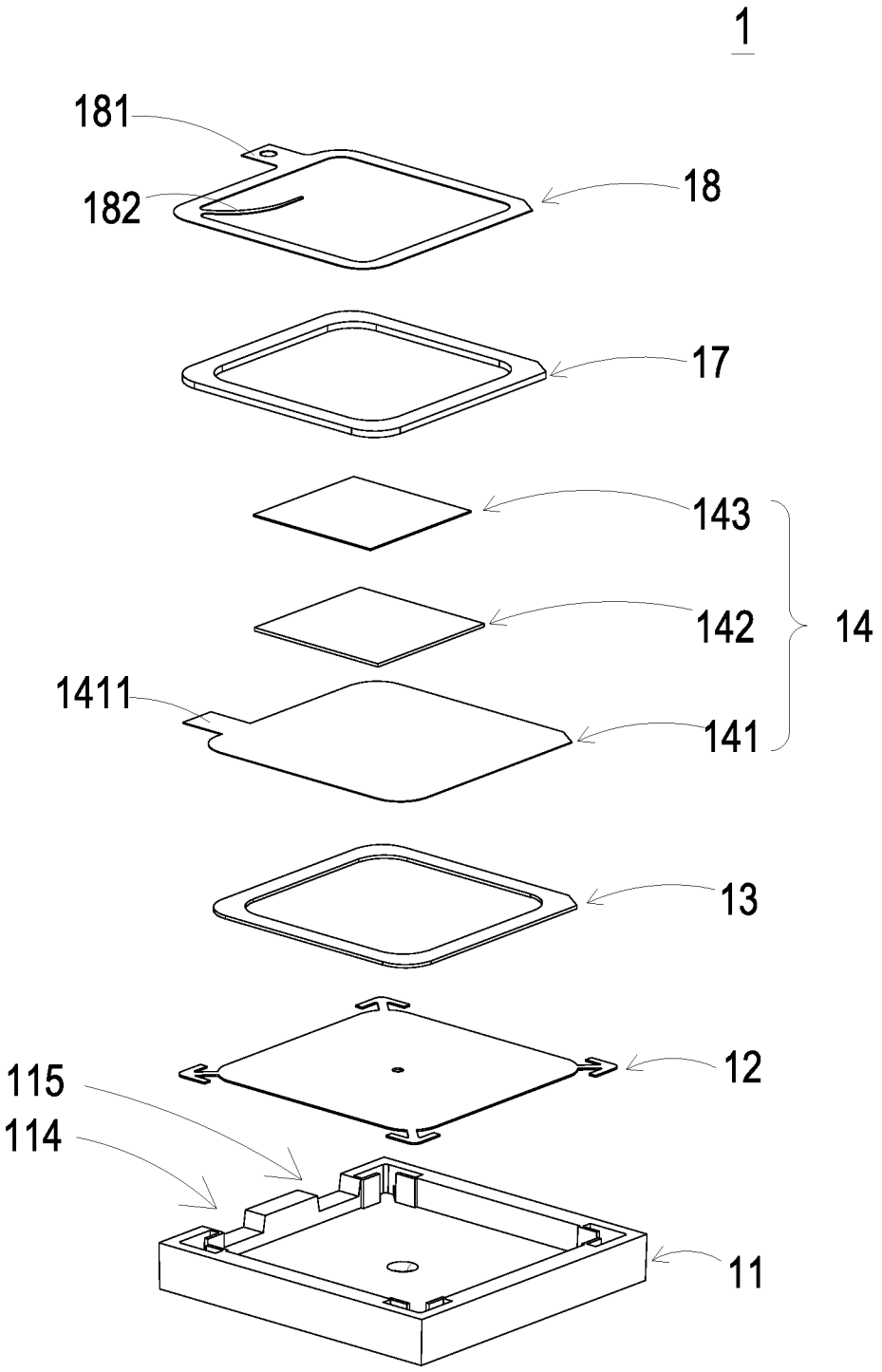
FIG. 2A is a schematic exploded perspective view illustrating the gas transportation device according to some embodiments of the present disclosure.
Figure 2B:
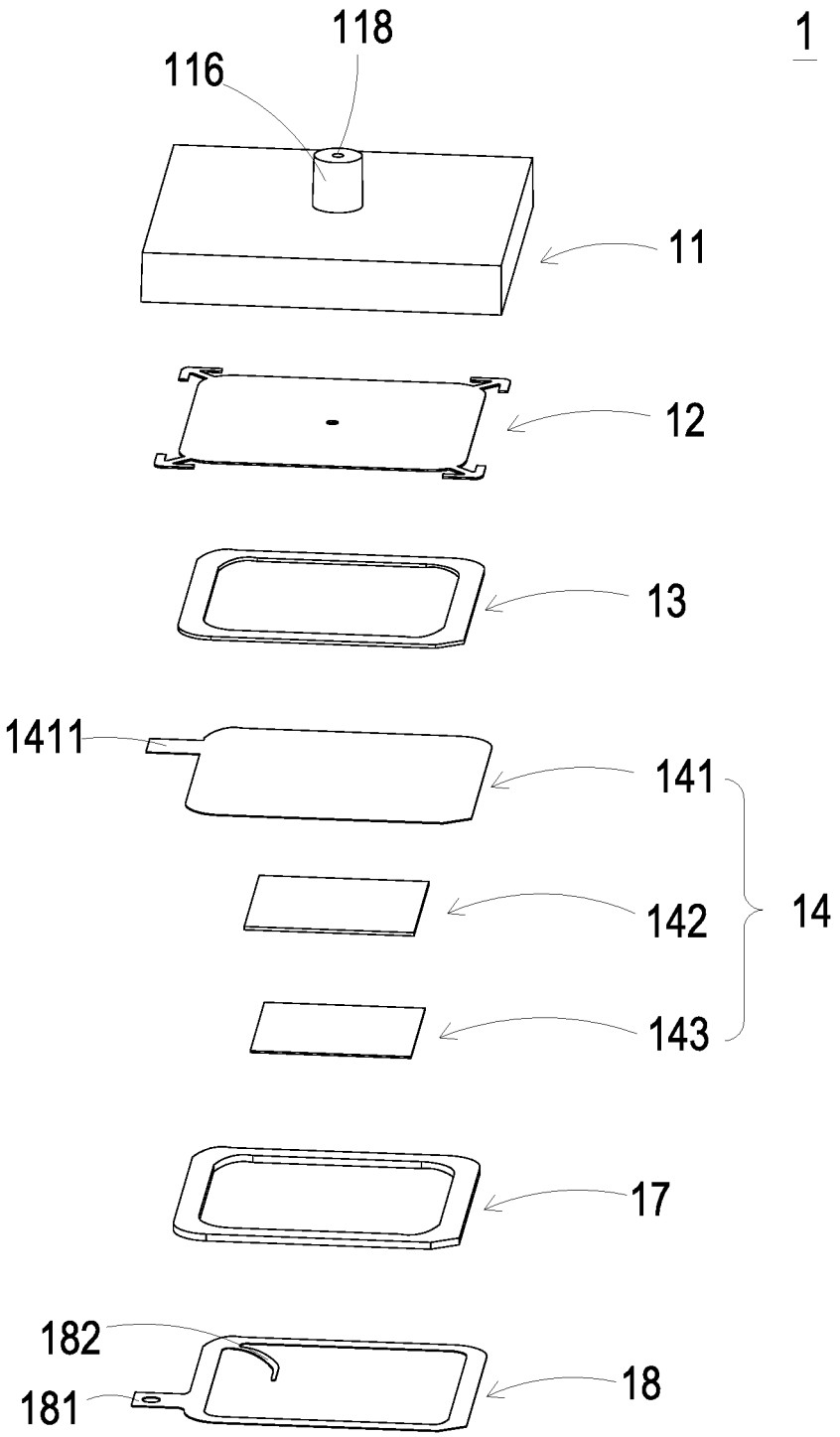
FIG. 2B is another schematic exploded perspective view illustrating the gas transportation device according to some embodiments of the present disclosure.
Figure 3:
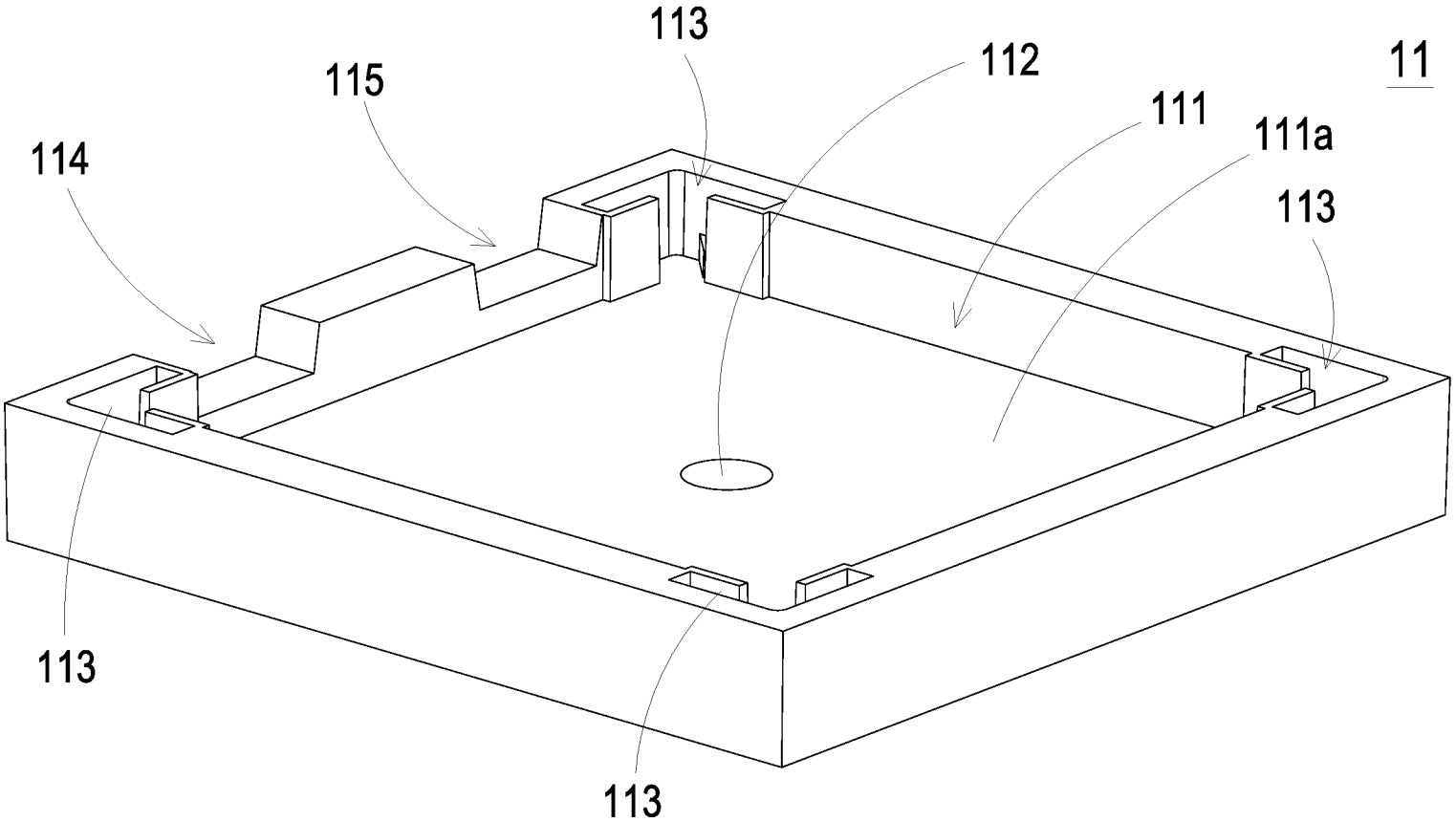
FIG. 3 is a schematic perspective view illustrating a casing of the gas transportation device.
Figure 4:
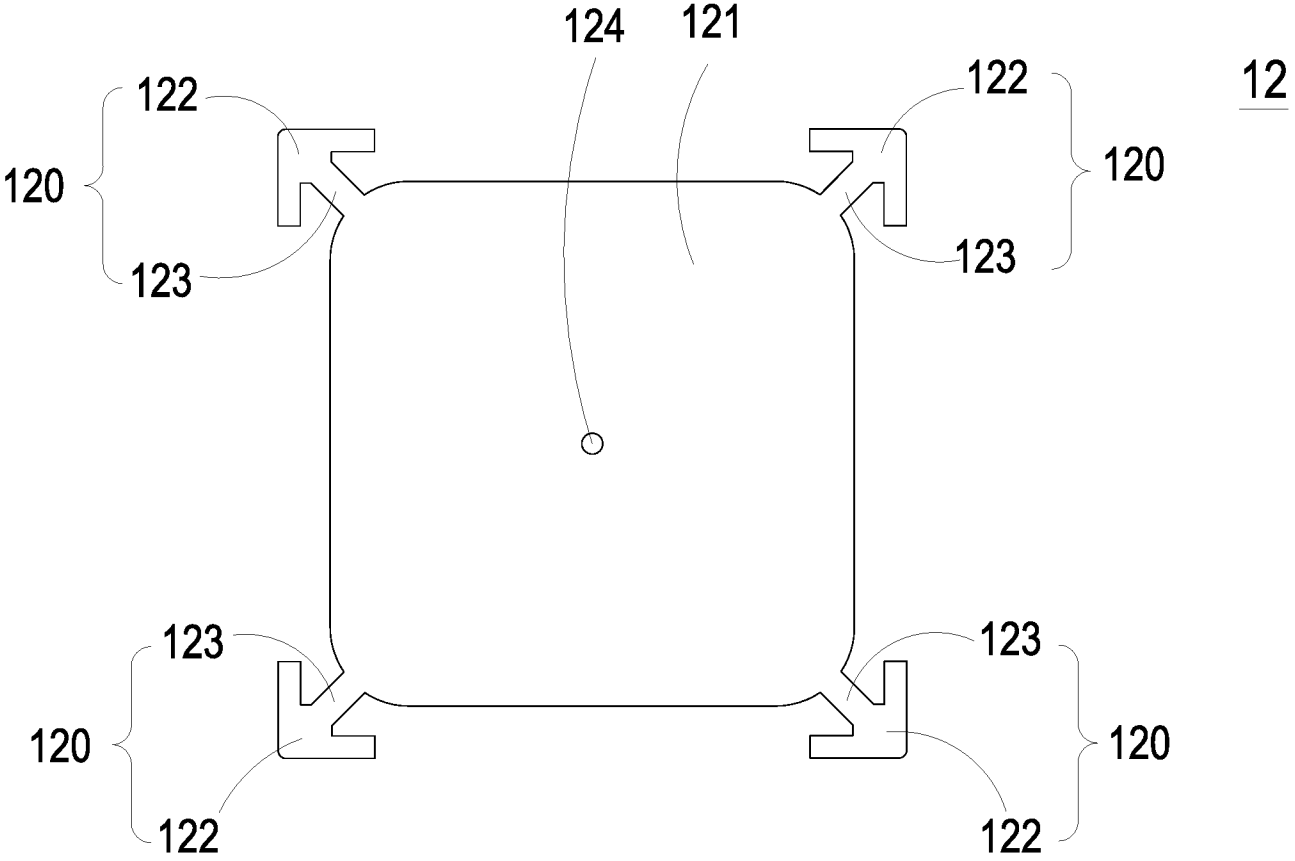
FIG. 4 is a schematic top view illustrating a nozzle plate of the gas transportation device.
Figure 5A:
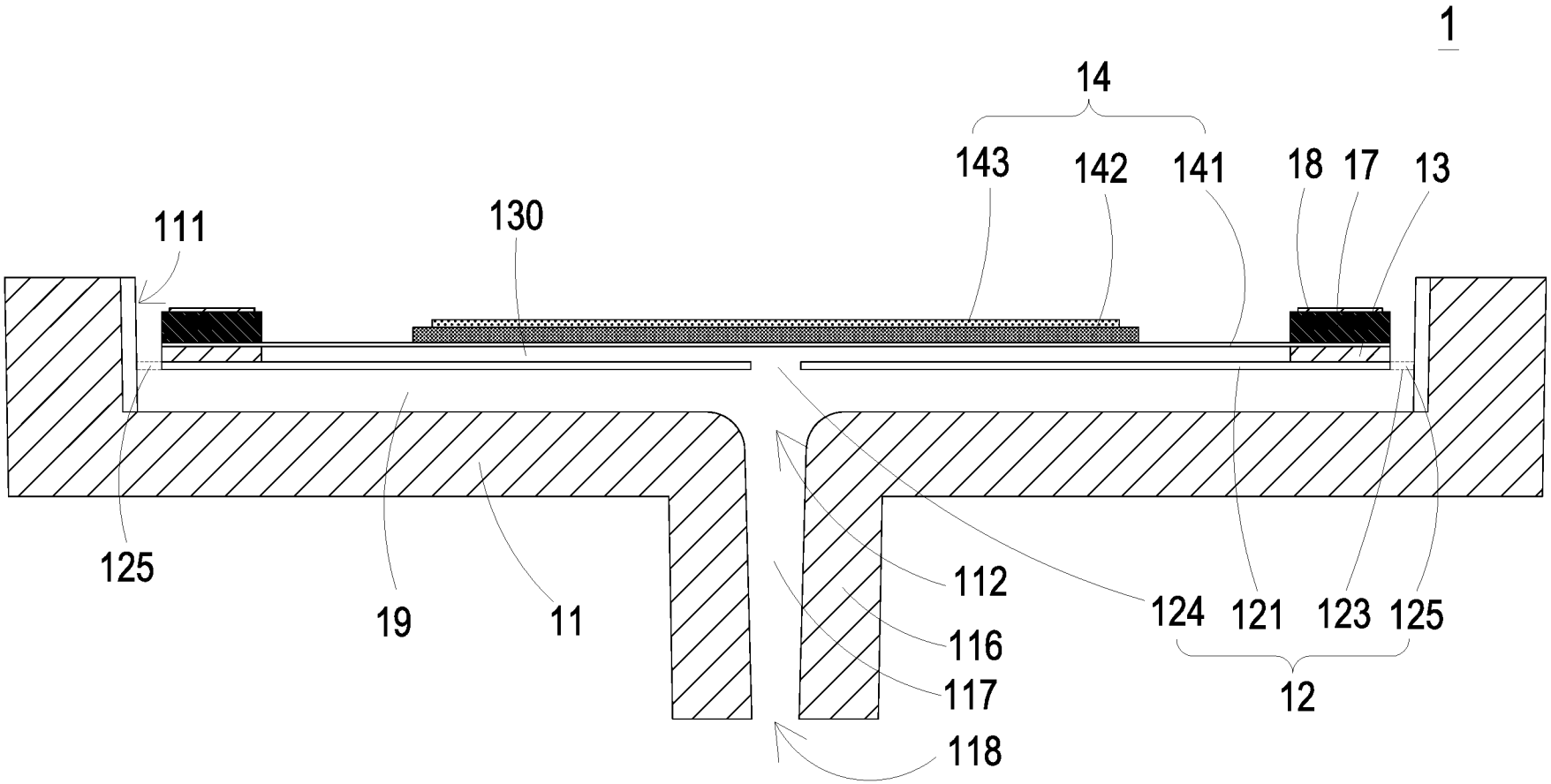
FIG. 5A is a schematic cross-sectional view illustrating the gas transportation device according to some embodiments of the present disclosure.
Figure 5B:
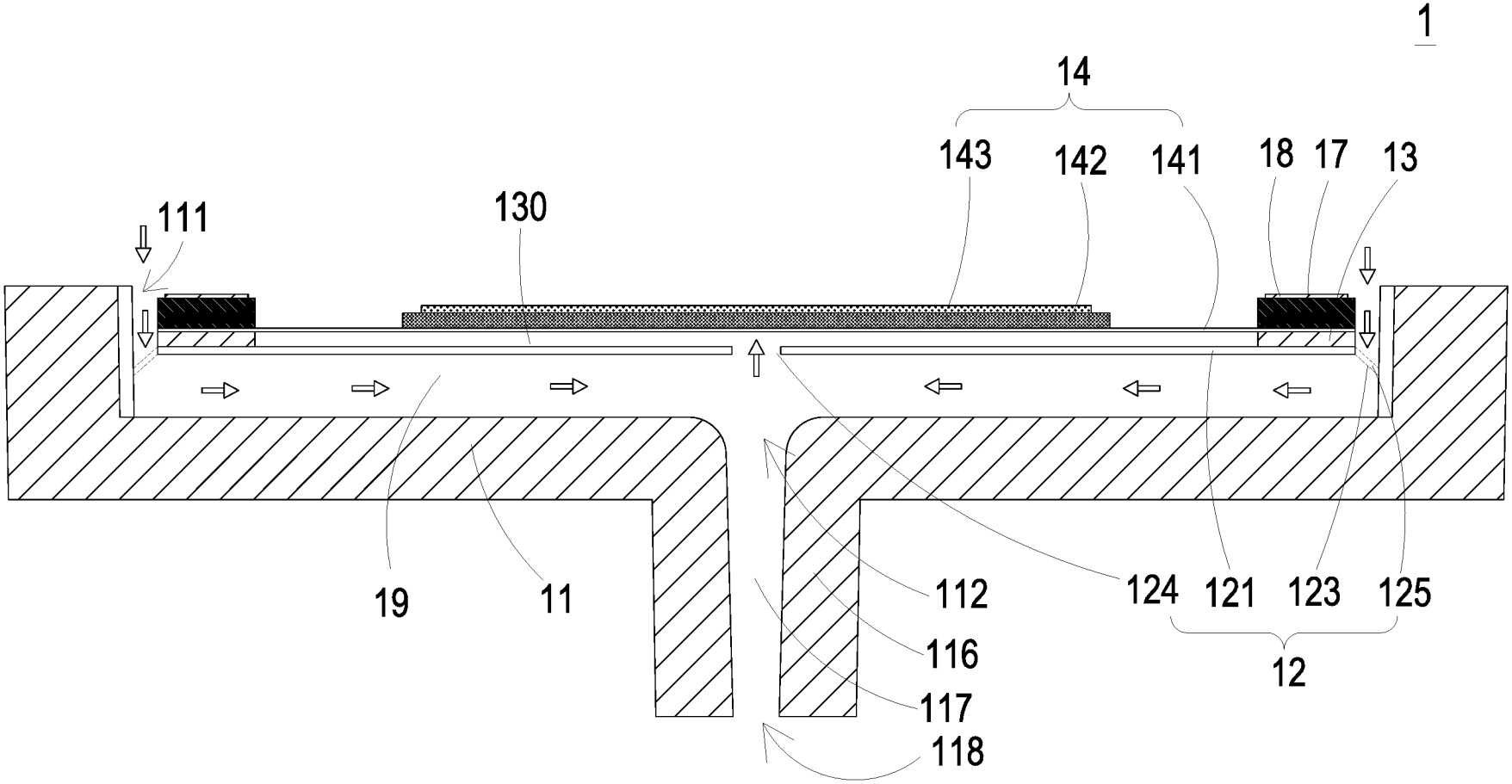
FIGS. 5B and 5C are schematic diagrams illustrating the actuations of the gas transportation device.
Figure 5C:
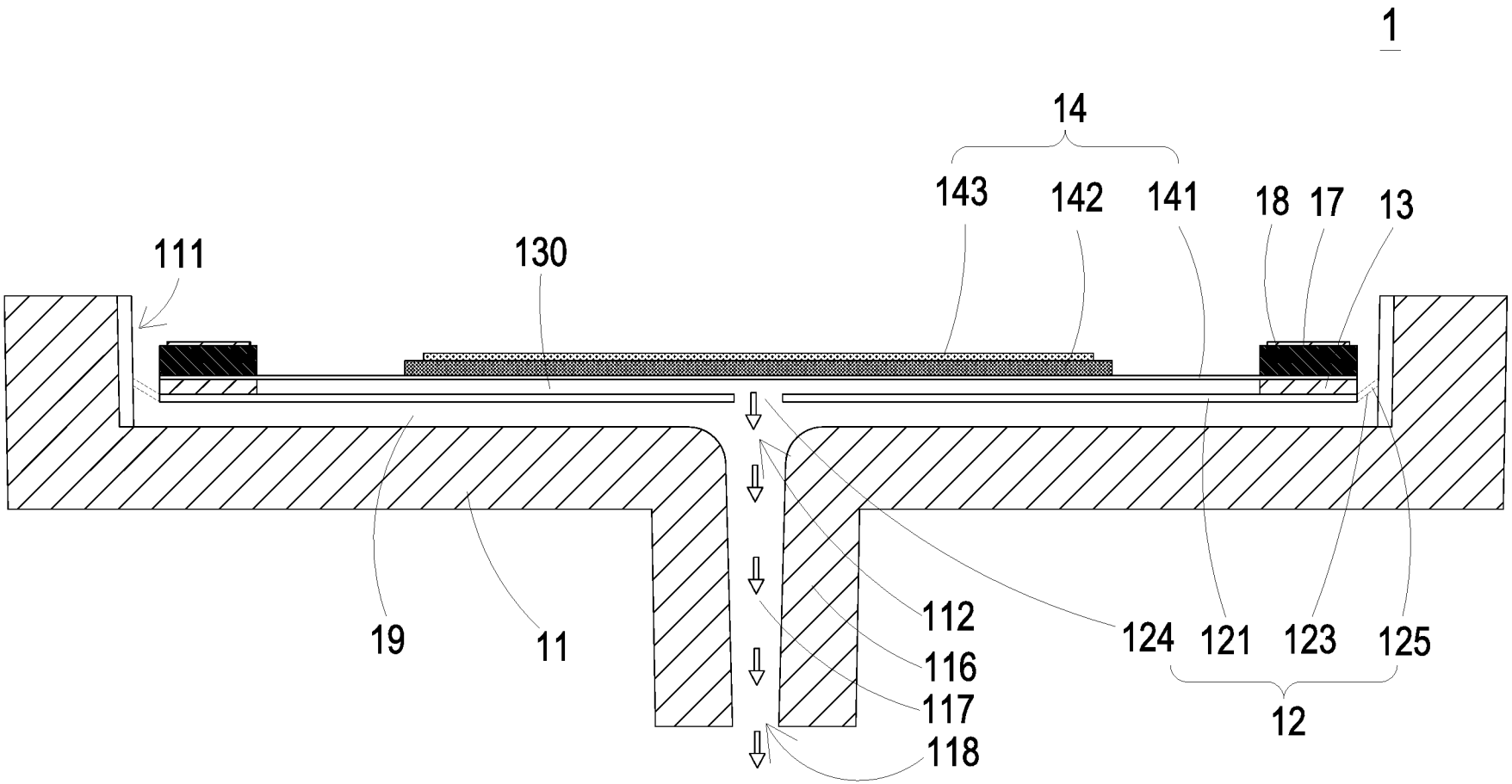

FIG. 1 is a schematic perspective view illustrating a gas transportation device according to some embodiments of the present disclosure. FIG. 2A is a schematic exploded perspective view illustrating the gas transportation device according to some embodiments of the present disclosure. FIG. 2B is another schematic exploded perspective view illustrating the gas transportation device according to some embodiments of the present disclosure. FIG. 3 is a schematic perspective view illustrating a casing of the gas transportation device. FIG. 4 is a schematic top view illustrating a nozzle plate of the gas transportation device. FIG. 5A is a schematic cross-sectional view illustrating the gas transportation device according to some embodiments of the present disclosure. FIGS. 5B and 5C are schematic diagrams illustrating the actuations of the gas transportation device. Referring to FIGS. 1 to 5C, the present discourse provides a gas transportation device 1. The gas transportation device 1 includes at least one casing 11 having at least one fixing recess 113, at least one accommodation recess 111 and at least one discharging opening 112, at least one nozzle plate 12 having at least one bracket 120, at least one suspension plate 121 and at least one through hole 124, at least one chamber frame 13, at least one actuator 14, at least one insulating frame 17 and at least one conducting frame 18. The at least one nozzle plate 12 and a bottom wall 111*a* of the at least one accommodation recess 111 collaboratively form at least one gas-guiding chamber 19. The at least one bracket 120, the at least one suspension plate 121 and the at least one casing 11 collaboratively define at least one interspace 125. The at least one actuator 14, the at least one chamber frame 13 and the at least one suspension plate 121 collaboratively form at least one cuboidal resonance chamber 130. It is noted that, the number of the at least one casing 11, the at least one accommodation recess 111, the at least one discharging opening 112, the at least one nozzle plate 12, the at least one suspension plate 121, the at least one through hole 124, the at least one gas-guiding chamber 19, the at least one chamber frame 13, the at least one actuator 14, the at least one insulating frame 17, the at least one conducting frame 18 and the at least one cuboidal resonance chamber 130 is exemplified by one for each in the following embodiments but not limited thereto. It is noted that each of the casing 11, the accommodation recess 111, the discharging opening 112, the nozzle plate 12, the suspension plate 121, the through hole 124, the gas-guiding chamber 19, the chamber frame 13, the actuator 14, the insulating frame 17, the conducting frame 18 and the cuboidal resonance chamber 130 can also be provided in plural numbers.

Referring to FIGS. 1, 2A and 2B, in some embodiments, the gas transportation device 1 is a miniature gas transportation structure for transporting a great amount of gas at a high speed. The gas transportation device 1 includes a casing 11, a nozzle plate 12, a chamber frame 13, an actuator 14, an insulating frame 17 and a conducting frame 18, which are stacked on each other sequentially.

Referring to FIGS. 2A, 2B and 3. In some embodiments, the casing 11 has an accommodation recess 111, a discharging opening 112, at least one fixing recess 113, a plate conducing pin opening 114, a frame conducting pin opening 115 and a conduit 116. The accommodation recess 111 has a bottom wall 111*a*, and the accommodation recess 111 is a square recessed structure concavely formed in the interior of the casing 11. That is, the bottom wall 111*a* of the accommodation recess 111 is square-shaped, but not limited thereto. In some other embodiments, the accommodation recess 111 may have a circular profile, an elliptic profile, a triangular profile or a polygonal profile. The accommodation recess 111 is disposed for accommodating the assembling of the nozzle plate 12, the chamber frame 13, the actuator 14, the insulating frame 17 and the conducting frame 18, which are stacked on each other. In some embodiments, the discharging opening 112 extends through a central portion of the bottom wall 111*a* for allowing the gas to flow therethrough. As shown in FIG. 5A, the discharging opening 112 is in communication with the conduit 116. In some embodiments, the nozzle plate 12 is fixedly disposed in the at least one fixing recess 113. In some embodiments, the casing 11 has four fixing recesses 113, which are located proximate to four corners of the accommodation recess 111, respectively. Preferably but not exclusively, the fixing recesses 113 are arrow-shaped. The number and shapes of the fixing recesses 113 are not restricted and can be varied according to the practical requirements. Referring to FIGS. 2B and 3, the conduit 116 is a hollow cylindrical structure, and includes a guiding channel 117 and an outlet 118. The guiding channel 117 of the conduit 116 is in communication with the accommodation recess 111 through the discharging opening 112. The guiding channel 117 of the conduit 116 is in communication with the exterior of the casing 11 through the outlet 118. A diameter of the discharging opening 112 is greater than a diameter of the outlet 118. In other words, a diameter of the guiding channel 117 is tapered from an end proximate to the discharging opening 112 to the other end proximate to the outlet 118. For example, the guiding channel 117 has a cone shape. The diameter of the discharging opening 112 is in the range between 0.85 millimeters and 1.25 millimeters. The diameter of the outlet 118 is in the range between 0.8 millimeters and 1.2 millimeters. When the gas is introduced into the conduit 116 from the discharging opening 112 and is discharged from the guiding channel 117, the gas is obviously converged so that the great amount of the collected gas is rapidly ejected from the guiding channel 117 of the conduit 116. It is noted that numerous modifications and alterations may be made while retaining the teachings of the disclosure. For example, in some other embodiments, the conduit 116 may be omitted. That is, the gas can be directly discharged from the casing 11 through the discharging opening 112.

Referring to FIGS. 2A, 2B, 3 and 4, in some embodiments, the nozzle plate 12 has at least one bracket 120, a suspension plate 121 and a through hole 124. The suspension plate 121 is a piece structure permitted to undergo a bending vibration. The shape of the suspension plate 121 corresponds to the shape of the accommodation recess 111, but not limited thereto. For example, the suspension plate 121 may have a square shape, a circular shape, an elliptic shape, a triangular shape or a polygonal shape. The through hole 124 extends through a central portion of the suspension plate 121 for allowing the gas to flow therethrough. In some embodiments, the nozzle plate 12 has four brackets 120, but not limited thereto. The number and type of the brackets 120 match with the number and type of the fixing recesses 113. Moreover, the number and type of the brackets 120 may be varied according to the practical requirements. In some embodiments, each of the brackets 120 has a fixing part 122 and a connecting part 123. The fixing part 122 of each of the brackets 120 and each of the fixing recesses 113 are L-shaped. In such a manner, the fixing part 122 of each of the brackets 120 is fixedly accommodated within a corresponding one of the fixing recesses 113. Since the shape of the fixing part 122 of each of the brackets 120 matches with that of each of the fixing recesses 113, the fixing part 122 of each of the brackets 120 can be positionally accommodated in the corresponding one of the fixing recesses 113 with an enhanced strength. In addition, since the brackets 120 are respectively and fixedly accommodated in the fixing recesses 113, the nozzle plate 12 is accommodated within the accommodation recess 111 of the casing 11. Moreover, since the fixing part 122 of each of the brackets 120 and the corresponding one of the fixing recesses 113 are engaged with each other, the nozzle plate 12 can be positionally accommodated in the accommodation recess 111 of the casing 11 more rapidly and precisely. Due to the simple structures of the nozzle plate 12 and the casing 11, an assembling process is convenient. Under this circumstance, the size precision of the gas transportation device is enhanced.

Referring to FIGS. 1, 3, 4 and 5A, the connecting part 123 is connected between the suspension plate 121 and the fixing part 122. Moreover, the connecting part 123 is elastic, so that the suspension plate 121 is permitted to undergo bending vibration in a reciprocating manner. In some embodiments, a plurality of interspaces 125 are formed between the brackets 120, the suspension plate 121 and the accommodation recess 111 of the casing 11. With the disposition of the interspaces, the gas can be transported to a region between the accommodation recess 111 and the suspension plate 121 through the interspaces 125. Consequently, the gas transportation device 1 can further transport the gas.

Referring to FIGS. 2A, 2B and 5A, a resonance chamber 130 is defined by the nozzle plate 12, the chamber frame 13 and the actuator 14 collaboratively. The chamber frame 13 may be a square frame structure. For complying with the chamber frame 13, the resonance chamber 130 may be a cuboidal resonance chamber. A capacity of the resonance chamber 130 is in the range between 6.3 cubic millimeters and 186 cubic millimeters. Moreover, in some embodiments, the actuator 14 includes a carrier plate 141, an adjusting resonance plate 142 and a piezoelectric plate 143. The carrier plate 141 may be a metal plate. A plate conducting pin 1411 extends from an edge of the carrier plate 141 to be electrically connected to a driving power. The adjusting resonance plate 142 is stacked on the carrier plate 141. The adjusting resonance plate 142 may also be a metal plate. The piezoelectric plate 143 is stacked on the adjusting resonance plate 142. Since the adjusting resonance plate 142 is disposed between the piezoelectric plate 143 and the carrier plate 141, when the piezoelectric plate 143 is subjected to a deformation in response to the driving power according to the piezoelectric effect, the adjusting resonance plate 142 is configured as a buffering element between the piezoelectric plate 143 and the carrier plate 141 for adjusting a vibration frequency of the carrier plate 141. A thickness of the adjusting resonance plate 142 is greater than that of the carrier plate 141. The vibration frequency of the actuator 14 is adjustable according to the thickness of the adjusting resonance plate 142. Consequently, the vibration frequency of the actuator 14 is controlled to be in the range between 10 KHz and 30 KHz. In some embodiments, the thickness of the carrier plate 141 is in the range between 0.04 millimeters and 0.06 millimeters. The thickness of the adjusting resonance plate 142 is in the range between 0.1 millimeters and 0.3 millimeters. A thickness of the piezoelectric plate 143 is in the range between 0.05 millimeters and 0.15 millimeters.

Further referring to FIGS. 2A, 2B and 5A, a gas-guiding chamber 19 is formed between the nozzle plate 12 and the accommodation recess 111. The gas-guiding chamber 19 is in communication with the discharging opening 112. A height of the gas-guiding chamber 19 is in the range between the 0.2 millimeters and 0.8 millimeters.

Referring back to FIGS. 1, 2A and 2B, the insulating frame 17 and the conducting frame 18 are stacked on the actuator 14. The conducting frame 18 includes a frame conducting pin 181 and an electrode 182. The electrode 182 is electrically connected to the piezoelectric plate 143 of the actuator 14. The frame conducting pin 181 of the conducting frame 18 and the plate conducting pin 1411 of the carrier plate 141 respectively protrude outwardly from the frame conducting pin opening 115 and the plate conducting pin opening 114 of the casing 11 in order to be electrically connected the driving power from an external power source (not shown). Consequently, a loop is defined by the carrier plate 141, the adjusting resonance plate 142, the piezoelectric plate 143 and the conducting frame 18 collaboratively. The disposition of the insulating frame 17 between the conducting frame 18 and the carrier plate 141 ensures that a direct contact between the conducting frame 18 and the carrier plate 141 is prevented since the direction contact between the conducting frame 18 and the carrier plate 141 may cause a short-circuited problem.

As shown in FIG. 5A, the gas transportation device 1 is not driven and in an initial state. In some embodiments, by controlling a gas vibration frequency in the cuboidal resonance chamber 130 to be close to the vibration frequency of the suspension plate 121, a Helmholtz resonance effect is produced by the cuboidal resonance chamber 130 and the suspension plate 121. Consequently, the gas transportation efficiency is enhanced. As shown in FIG. 5B, when the actuator 14 is driven and the piezoelectric plate 143 vibrates away from the discharging opening 112 of the casing 11, the suspension plate 121 of the nozzle plate 12 also vibrates away from the discharging opening 112 of the casing 11. Meanwhile, the gas is inhaled into the gas-guiding chamber 19 through the plurality of interspaces 125, and then the gas is transported to the cuboidal resonance chamber 130 through the through hole 124. In such a manner, a gas pressure in the cuboidal resonance chamber 130 is increased, and a pressure gradient is generated. As shown in FIG. 5C, when the piezoelectric plate 143 vibrates toward the discharging opening 112 of the casing 11, the suspension plate 121 of the nozzle plate 12 also vibrates toward the discharging opening 112 of the casing 11. Meanwhile, the gas flows out of the cuboidal resonance chamber 130 rapidly through the through hole 124 and compresses the air in the gas-guiding chamber 19. Then, the gas is transported to the conduit 116, which is tapered from the end proximate to the discharging opening 112 to the other end proximate to the outlet 118, through the discharging opening 112 so as to converge the gas. Subsequently, the great amount of the converged gas, which is in the ideal fluid state complying with the Bernoulli's principle, is rapidly ejected from the outlet 118 of the conduit 116. In addition, according to the principle of inertial, the gas pressure in the cuboidal resonance chamber 130 is less than the equilibrium gas pressure, so that the gas is introduced into the cuboidal resonance chamber 130 again. With reciprocating vibration of the piezoelectric plate 143, and by controlling the gas vibration frequency in the cuboidal resonance chamber 130 to be substantially equal to the vibration frequency of the piezoelectric plate 143, the Helmholtz resonance effect is produced for implementing the gas transportation at the high speed and in a large quantity.

From the above descriptions, the present disclosure provides the gas transportation device. When the voltage is applied to the piezoelectric plate, the piezoelectric plate vibrates in the reciprocating manner to drive the vibration of the cuboidal resonance chamber. Since the pressure in the cuboidal resonance chamber is subjected to a change, the purpose of transporting the gas is achieved. Moreover, since the L-shaped connecting part of each of the brackets and the corresponding one of the L-shaped fixing recesses are engaged with each other, the nozzle plate can be easily and precisely positioned in the accommodation recess of the casing. That is, the gas transportation device of the present disclosure is miniature and has enhanced size precision. Furthermore, since the contact areas between the brackets and the casing are increased, the connecting strength between the brackets and the casing is enhanced. Furthermore, since the gas vibration frequency in the cuboidal resonance chamber is substantially equal to the vibration frequency of the piezoelectric plate, the Helmholtz resonance effect is produced to transport the great amount of gas at the high speed. Furthermore, since the diameter of the guiding channel of the conduit is tapered from the end proximate to the discharging opening to the other end proximate to the outlet, the gas is further converged, and the converged gas is in the ideal fluid state complying with the Bernoulli's principle and is rapidly ejected. Consequently, the purpose of transporting the gas at the high speed is achieved.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A gas transportation device for transporting gas, comprising:

a casing having at least one fixing recess, an accommodation recess and a discharging opening, wherein the accommodation recess has a bottom wall;

a nozzle plate having at least one bracket, a suspension plate and a through hole, wherein the suspension plate is permitted to undergo a bending vibration, and the at least one bracket is disposed in the at least one fixing recess for positionally accommodating the nozzle plate within the accommodation recess, wherein a gas-guiding chamber is formed between the nozzle plate and the bottom wall of the accommodation recess, and the gas-guiding chamber is in communication with the discharging opening, and wherein at least one interspace is formed among the at least one bracket, the suspension plate and the casing;

a chamber frame being square-shaped and stacked on the suspension plate;

an actuator stacked on the chamber frame, wherein in response to a voltage applied to the actuator, the actuator undergoes a bending vibration in a reciprocating manner;

an insulating frame stacked on the actuator; and a conducting frame stacked on the insulating frame, wherein a cuboidal resonance chamber is defined by the actuator, the chamber frame and the suspension plate collaboratively, and wherein when the actuator is driven, the nozzle plate is subjected to a resonance and the suspension plate of the nozzle plate vibrates in the reciprocating manner, so that the gas is transported to the gas-guiding chamber through the at least one interspace and discharged from the discharging opening so as to implement a gas circulation.

2. The gas transportation device according to claim 1, wherein each at least one bracket has a fixing part and a connecting part, wherein a shape of the fixing part corresponds to a shape of the corresponding at least one fixing recess, and each connecting part is connected between the corresponding suspension plate and the corresponding fixing part, and wherein each connecting part elastically supports the suspension plate, so that the suspension plate undergoes the bending vibration in the reciprocating manner.

3. The gas transportation device according to claim 2, wherein each connecting part of each at least one bracket is L-shaped, and each at least one fixing recess is L-shaped.

4. The gas transportation device according to claim 1, wherein the accommodation recess has a square profile.

5. The gas transportation device according to claim 1, wherein the suspension plate has a square profile.

6. The gas transportation device according to claim 1, wherein the actuator includes:

a carrier plate stacked on the chamber frame;

an adjusting resonance plate stacked on the carrier plate; and a piezoelectric plate stacked on the adjusting resonance plate, wherein when the voltage is applied to the piezoelectric plate, the carrier plate and the adjusting resonance plate undergo the bending vibration in the reciprocating manner.

7. The gas transportation device according to claim 6, wherein the carrier plate has a square profile.

8. The gas transportation device according to claim 6, wherein a thickness of the adjusting resonance plate is greater than a thickness of the carrier plate.

9. The gas transportation device according to claim 6, wherein the carrier plate has a plate conducting pin, and the casing has a plate conducting pin opening, and wherein the plate conducting pin of the carrier plate is positioned by the plate conducting pin opening and protrudes out of the casing through the plate conducting pin opening.

10. The gas transportation device according to claim 6, wherein the conducting frame has a frame conducting pin and an electrode, and the electrode is electrically connected to the piezoelectric plate, and wherein the casing further has a frame conducting pin opening, and the frame conducting pin of the conducting frame is positioned by the frame conducting pin opening and protrudes out of the casing through the frame conducting pin opening.

11. The gas transportation device according to claim 6, wherein a vibration frequency of the piezoelectric plate is in a range between 10 KHz and 30 KHz.

12. The gas transportation device according to claim 1, wherein:

a conduit protrudes from the casing and is aligned with the discharging opening of the casing; and the conduit has a guiding channel, and the guiding channel is in communication with the discharging opening and is in communication with the exterior of the casing.

13. The gas transportation device according to claim 12, wherein the guiding channel has a cone shape and has a diameter tapered from the discharging opening.

14. The gas transportation device according to claim 12, wherein a diameter of the discharging opening is in a range between 0.85 millimeters and 1.25 millimeters, and a diameter of the guiding channel is in a range between 0.8 millimeters and 1.2 millimeters.

15. The gas transportation device according to claim 6, wherein a thickness of the carrier plate is in a range between 0.04 millimeters and 0.06 millimeters.

16. The gas transportation device according to claim 6, wherein a thickness of the adjusting resonance plate is in a range between 0.1 millimeters and 0.3 millimeters.

17. The gas transportation device according to claim 6, wherein a thickness of the piezoelectric plate is in a range between 0.05 millimeters and 0.15 millimeters.

18. The gas transportation device according to claim 1, wherein a height of the gas-guiding chamber is in a range between the 0.2 millimeters and 0.8 millimeters.

19. The gas transportation device according to claim 1, wherein a capacity of the resonance chamber is in a range between 6.3 cubic millimeters and 186 cubic millimeters.

* * * * *